US010922923B2

(12) United States Patent
Ludwick

(10) Patent No.: US 10,922,923 B2
(45) Date of Patent: Feb. 16, 2021

(54) SYSTEMS AND METHODS FOR DISPLAYING AN OVERSIZED SYMBOL ACROSS MULTIPLE REELS

(71) Applicant: Aristocrat Technologies Australia Pty Limited, North Ryde (AU)

(72) Inventor: John Ludwick, Charlottesville, VA (US)

(73) Assignee: Aristocrat Technologies Australia Pty Ltd., North Ryde (AU)

( * ) Notice: Subject to any disclaimer, the term of this patent is extended or adjusted under 35 U.S.C. 154(b) by 5 days.

(21) Appl. No.: 15/926,794

(22) Filed: Mar. 20, 2018

(65) Prior Publication Data

US 2019/0295376 A1 Sep. 26, 2019

(51) Int. Cl.
*G07F 17/32* (2006.01)
*G07F 17/34* (2006.01)

(52) U.S. Cl.
CPC ..... *G07F 17/3267* (2013.01); *G07F 17/3211* (2013.01); *G07F 17/34* (2013.01)

(58) Field of Classification Search
CPC ... G07F 17/3211; G07F 17/3267; G07F 17/34
USPC ..... 463/20
See application file for complete search history.

(56) References Cited

U.S. PATENT DOCUMENTS 6,375,570 B1 * 4/2002 Poole ..... G07F 17/3211 463/20
6,719,630 B1 * 4/2004 Seelig ..... G07F 17/3211 463/16
9,240,104 B2 1/2016 Lange et al.
9,666,020 B2 * 5/2017 Gobe ..... G07F 17/3213
9,773,369 B2 * 9/2017 Berman ..... G07F 17/34
9,916,727 B2 3/2018 Nakamura et al.
10,354,493 B2 * 7/2019 Kudo ..... G07F 17/3213
2003/0176216 A1 9/2003 Storey
2004/0043809 A1 * 3/2004 Gomez ..... G07F 17/32 463/16
2006/0009277 A1 1/2006 Hartl et al.
2006/0073876 A1 * 4/2006 Cuddy ..... G07F 17/3244 463/20
2008/0032784 A1 * 2/2008 Englman ..... G07F 17/3265 463/21
2008/0132322 A1 * 6/2008 Yoshizawa ..... G07F 17/32 463/20

(Continued)

*Primary Examiner* — Chase E Leichliter
(74) *Attorney, Agent, or Firm* — Armstrong Teasdale LLP

(57) ABSTRACT

An EGM is provided including a display and a game controller coupled to the display. The display selectively displays a primary and secondary game in primary and secondary matrices. The primary matrix includes a trigger column and a plurality of combinable columns corresponding to a first plurality of virtual reels. The secondary matrix includes the trigger column and a combined column corresponding to a second plurality of virtual reels. Symbols appearing in the combined column are oversized. The primary matrix is displayed and the first plurality of virtual reels are spun and stopped to conduct the primary game, where a trigger symbol appears in the trigger column. The secondary game is selected and the secondary matrix is displayed in response to the appearance of the trigger symbol. The second plurality of virtual reels are spun and stopped to conduct the secondary game in which a secondary game award is awarded.

16 Claims, 12 Drawing Sheets

(56) References Cited

U.S. PATENT DOCUMENTS

2008/0146319 A1* 6/2008 Yoshizawa ..... G07F 17/3265 463/21
2009/0253488 A1* 10/2009 Yoshizawa ..... G07F 17/34 463/20
2010/0004050 A1* 1/2010 Caputo ..... G07F 17/3265 463/21
2010/0279760 A1 11/2010 Sugiyama
2011/0081964 A1 4/2011 Acres
2011/0201406 A1* 8/2011 Jaffe ..... G07F 17/32 463/21
2012/0172106 A1* 7/2012 Caputo ..... G07F 17/34 463/20
2013/0184050 A1* 7/2013 Zoble ..... G07F 17/3213 463/20
2014/0080570 A1* 3/2014 Watkins ..... G07F 17/3267 463/20
2014/0087830 A1* 3/2014 Gobe ..... G07F 17/34 463/20
2014/0162751 A1* 6/2014 Ryan ..... G07F 17/34 463/20
2014/0187311 A1 7/2014 Suda et al.
2014/0256402 A1* 9/2014 Caputo ..... G07F 17/34 463/20
2014/0274288 A1* 9/2014 Hornik ..... G07F 17/34 463/20
2015/0018071 A1* 1/2015 Elias ..... G07F 17/326 463/20
2016/0093152 A1* 3/2016 Hendricks ..... G07F 17/3216 463/21
2016/0125687 A1 5/2016 Berman
2016/0351006 A1 12/2016 Igesund
2017/0236383 A1* 8/2017 Nakamura ..... G07F 17/3213 463/20
2017/0270743 A1* 9/2017 Guerrero ..... G07F 17/3213
2018/0211478 A1* 7/2018 Elias ..... G07F 17/326

* cited by examiner

SYSTEMS AND METHODS FOR DISPLAYING AN OVERSIZED SYMBOL ACROSS MULTIPLE REELS

TECHNICAL FIELD

The field of disclosure relates generally to electronic gaming, and more particularly to systems and methods for displaying an oversized symbol across multiple reels combined into a combined reel.

BACKGROUND

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Play on EGMs typically involves a player establishing a credit balance by inserting or otherwise submitting money and placing a monetary wager (deducted from the credit balance) on one or more outcomes of an instance, or play, of a primary game, sometimes referred to as a base game. In many games, a player may qualify for secondary games or bonus rounds by attaining a certain winning combination or other triggering event in the base game. Secondary games provide an opportunity to win additional game instances, credits, awards, jackpots, progressives, etc. Awards form any winning outcomes are typically added back to the credit balance and can be provided to the player upon completion of a gaming session or when the player wants to "cash out."

Slot games are often displayed to the player in the form of various symbols arranged in a row-by-column grid, or "matrix." Specific matching combinations of symbols along predetermined paths, or paylines, drawn through the matrix indicate the outcome of the game. The display typically highlights winning combinations and outcomes for ready identification by the player. Matching combinations and their corresponding awards are usually shown in a "paytable" that is available to the player for reference. Often, the player may vary his/her wager to included differing numbers of paylines and/or the amount bet on each line. By varying the wager, the player may sometimes alter the frequency or number of winning combinations, the frequency or number of secondary games, and/or the amount awarded.

Typical games use a random number generator (RNG) to randomly determine the outcome of each game. The game is designed to return a certain percentage of the amount wagered back to the player, referred to as return to player (RTP), over the course of many plays or instances of the game. The RTP and randomness of the RNG are fundamental to ensuring the fairness of the games and are therefore highly regulated. The RNG may be used to randomly determine the outcome of a game and symbols may then be selected that correspond to that outcome. Alternatively, the RNG may be used to randomly select the symbols whose resulting combinations determine the outcome. Notably, some games may include an element of skill on the part of the player and are therefore not entirely random.

BRIEF DESCRIPTION

Embodiments the electronic gaming machines (EGMs) and methods described herein provide an EGM on which a reel-based wagering game, or slot game, is conducted. The EGM displays a primary matrix and conducts a primary game utilizing one or more symbols or symbol stacks that may appear in one or more trigger columns, or reels, of the primary matrix to trigger a feature in which two or more columns, or reels, of the primary matrix are combined into a single column, or reel, for the purpose of conducting a secondary game. Accordingly, the combined reel is wider than a single original reel, and is populated with larger symbols. In certain embodiments, the symbols on the combined reel are both wider and taller, spanning both the width and height of the combined original reels in the matrix. Such symbols are sometimes referred to as "mega symbols." In certain embodiments, the secondary game is conducted for the purpose of awarding one or more of a jackpot, a progressive award, bonus games, and other monetary or non-monetary awards.

In one aspect, an EGM is provided. The EGM includes a display device and a game controller coupled to the display device. The display device is configured to selectively display a primary game in a primary matrix, and a secondary game in a secondary matrix. The primary matrix includes a trigger column and a plurality of combinable columns. The trigger column and the plurality of combinable columns correspond to a first plurality of virtual reels having respective pluralities of symbols defined thereon. The secondary matrix includes the trigger column and a combined column that represents a combination of the plurality of combinable columns from the primary matrix. The trigger column and the combined column correspond to a second plurality of virtual reels having respective pluralities of symbols defined thereon. The respective symbols appearing in the combined column are oversized to span the space of the plurality of combinable columns on the primary matrix. The game controller is configured to control the display device to display the primary matrix. The game controller is further configured to spin and stop the first plurality of virtual reels to conduct the primary game. At least one trigger symbol appears in the trigger column when the first plurality of virtual reels stops. The game controller is further configured to select the secondary game and control the display device to display the secondary matrix in response to the appearance of the at least one trigger symbol in the trigger column. The game controller is further configured to spin and stop the second plurality of virtual reels to conduct the secondary game. During the secondary game, when the second plurality of reels is stopped, at least one oversized symbol appears in the combined column.

In another aspect, a method of conducting a primary game and a secondary game on an electronic gaming machine is provided. The method includes controlling a display device to display a primary matrix including at least one trigger column and a plurality of combinable columns. The at least one trigger column and the plurality of combinable columns correspond to a first plurality of virtual reels having respective pluralities of symbols defined thereon. The method includes initiating a spin and stopping the first plurality of virtual reels to conduct the primary game. A trigger symbol is displayed in the at least one trigger column upon the stopping of the first plurality of virtual reels. The method includes enabling the secondary game and controlling the display device to display a secondary matrix in response to the appearance of the trigger symbol in the at least one trigger column. The secondary matrix includes the at least one trigger column and a combined column representing a combination of the plurality of combinable columns. The at least one trigger column and the combined column corresponding to a second plurality of virtual reels having respective pluralities of symbols defined thereon. The respective symbols appearing in the combined column are oversized to span the space of the plurality of combinable columns on the primary matrix. The method includes initiating a spin and stopping the second plurality of virtual reels to conduct the secondary game. When the second plurality of reels stop, at least one oversized symbol appears in the combined column.

BRIEF DESCRIPTION OF THE DRAWINGS

An example embodiment of the subject matter disclosed will now be described with reference to the accompanying drawings.

DETAILED DESCRIPTION

Embodiments of the gaming systems, gaming devices, and methods described herein provide an electronic gaming machine (EGM) on which a reel-based wagering game, or slot game, is conducted. The EGM conducts a primary game utilizing one or more symbols or symbol stacks to trigger a feature in which two or more reels are combined into a single reel for the purpose of conducting a secondary game. More specifically, a triggering symbol or symbol stack appearing on a particular reel in the matrix triggers the feature. For example, the feature is triggered when a triggering symbol or symbol stack appears in a left-most or right-most reel. In such an embodiment, two or more inner reels are combined into a single reel, sometimes referred to as a "mega reel," that spans the two or more original reels. Accordingly, the combined reel is wider than a single original reel, and is populated with larger symbols. In certain embodiments, the symbols on the combined reel are both wider and taller, spanning both the width and height of the combined original reels in the matrix. Such symbols are sometimes referred to as "mega symbols." Additionally, the reel strips defining the original reels are replaced by a different reel strip having the larger symbols defined thereon. Accordingly, the secondary game conducted on embodiments of the EGM described herein has an increased volatility with respect to the primary game, i.e., fewer reels, fewer symbols in the matrix, and increased awards in the secondary game. In certain embodiments, the secondary game is conducted for the purpose of awarding one or more of a jackpot, a progressive award, bonus games, and other monetary or non-monetary awards.

One embodiment of the gaming systems, gaming devices, and methods described herein is the Pillars of Perseus® EGM manufactured by Aristocrat® Technologies, Inc. The Pillars of Perseus EGM includes a Pillar Pays feature, or secondary game, that embodies the combined reel, or "mega reel," on which the oversized symbols, or "mega symbols," are displayed.

Figure 1:
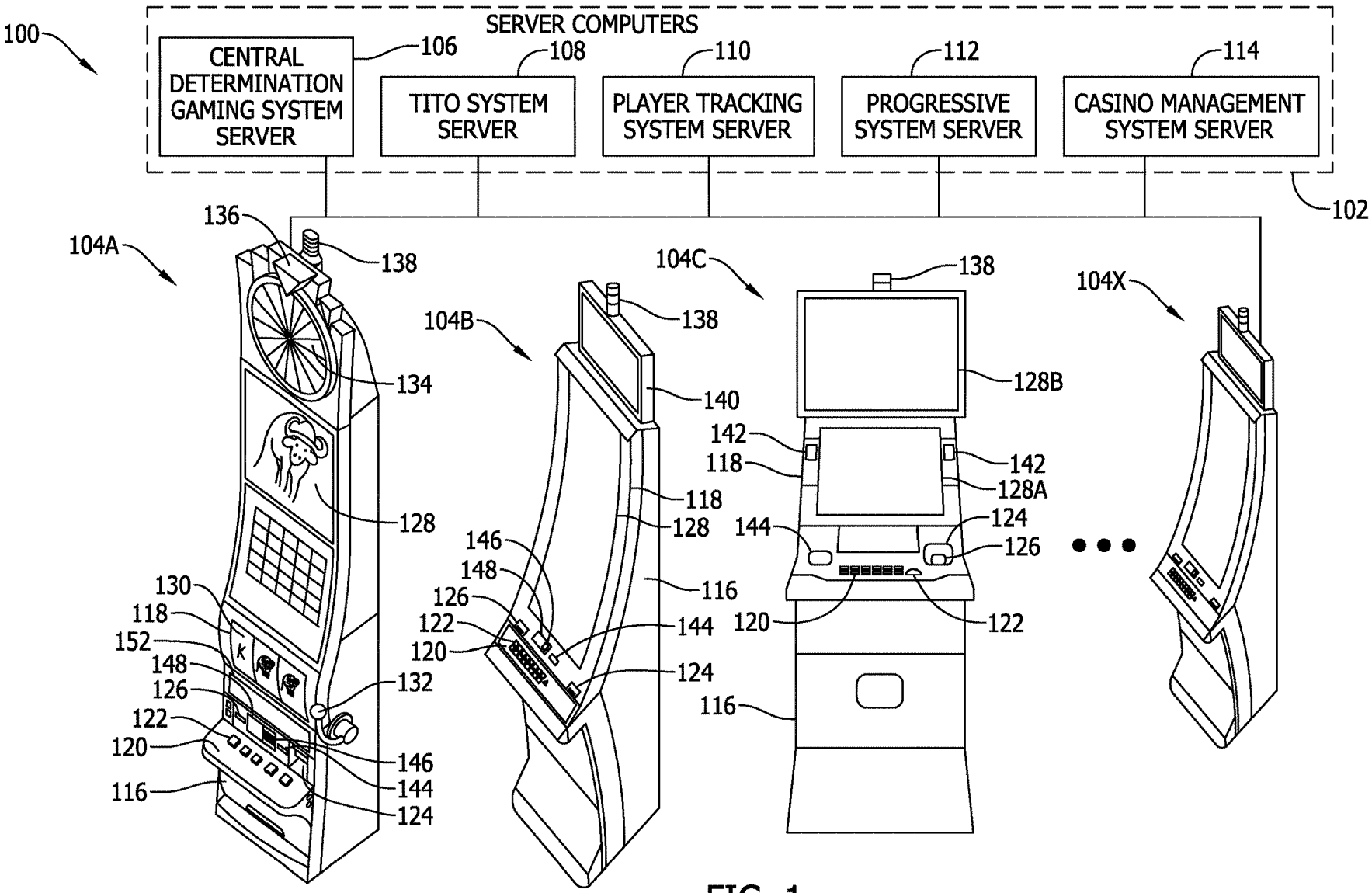
FIG. 1 is a diagram of exemplary EGMs networked with various gaming-related servers.

FIG. 1 is a diagram of exemplary EGMs networked with various gaming-related servers in a gaming system 100. Gaming system 100 operates in a gaming environment, including one or more servers, or server computers, such as slot servers of a casino, that are in communication, via a communications network, with one or more EGMs, or gaming devices 104A-104X, such as EGMs, slot machines, video poker machines, or bingo machines, for example. Gaming devices 104A-104X may, in the alternative, be portable and/or remote gaming devices such as, for example, and without limitation, a smart phone, a tablet, a laptop, or a game console.

Communication between gaming devices 104A-104X and servers 102, and among gaming devices 104A-104X, may be direct or indirect, such as over the Internet through a web site maintained by a computer on a remote server or over an online data network including commercial online service providers, Internet service providers, private networks, and the like. In other embodiments, gaming devices 104A-104X communicate with one another and/or servers 102 over wired or wireless RF or satellite connections and the like.

In certain embodiments, servers 102 may not be necessary and/or preferred. For example, the present invention may, in one or more embodiments, be practiced on a stand-alone gaming device such as gaming device 104A and/or gaming device 104A in communication with only one or more other gaming devices 104B-104X (i.e., without servers 102).

Servers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, a game outcome may be generated on a central determination gaming system server 106 and then transmitted over the network to any of a group of remote terminals or remote gaming devices 104A-104X that utilize the game outcome and display the result to the player.

Gaming device 104A is often of a cabinet construction that may be aligned in rows or banks of similar devices for placement and operation on a casino floor. The gaming device 104A often includes a main door 116 that provides access to the interior of the cabinet. Gaming device 104A typically includes a button area or button deck 120 accessible by a player that is configured with input switches or buttons 122, a bill validator 124, and/or ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 including a plurality of mechanical reels 130, typically 3 or 5 mechanical reels, with various symbols displayed there on. Reels 130 are then independently spun and stopped to show a set of symbols within the gaming display area 118 that may be used to determine an outcome to the game.

In many configurations, gaming machine 104A may have a main display 128 (e.g., video display monitor) mounted to, or above, gaming display area 118. Main display 128 may be, for example, a high-resolution LCD, plasma, LED, or OLED panel that may be flat or curved as shown, a cathode ray tube, or other conventional electronically controlled video monitor.

In certain embodiments, bill validator 124 may also function as a "ticket-in" reader that enables the player to use a casino-issued credit ticket to load credits onto gaming device 104A (e.g., in a cashless TITO system). In such cashless embodiments, gaming device 104A may also include a "ticket-out" printer 126 for outputting a credit ticket when a "cash out" button is pressed. Cashless ticket systems are well known in the art and are used to generate and track unique bar-codes printed on tickets to allow players to avoid the use of bills and coins by loading credits using a ticket reader and cashing out credits using ticket-out printer 126 on gaming device 104A.

In certain embodiments, a player tracking card reader 144, a transceiver for wireless communication with a player's smartphone, a keypad 146, and/or an illuminated display 148 for reading, receiving, entering, and/or displaying player tracking information can be provided. In such embodiments, a game controller within gaming device 104A communicates with player tracking server system 110 to send and receive player tracking information.

Gaming device 104A may also include, in certain embodiments, a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but could also be incorporated into play of the base game, or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

In certain embodiments, there may also be one or more information panels 152 that may be, for example, a back-lit silkscreened glass panel with lettering to indicate general game information including, for example, a game denomination (e.g., $0.25 or $1), pay lines, pay tables, and/or various game related graphics. In some embodiments, information panels 152 may be implemented as an additional video display.

Gaming device 104A traditionally includes a handle 132 typically mounted to the side of main cabinet 116 that may be used to initiate game play.

Figure 2:
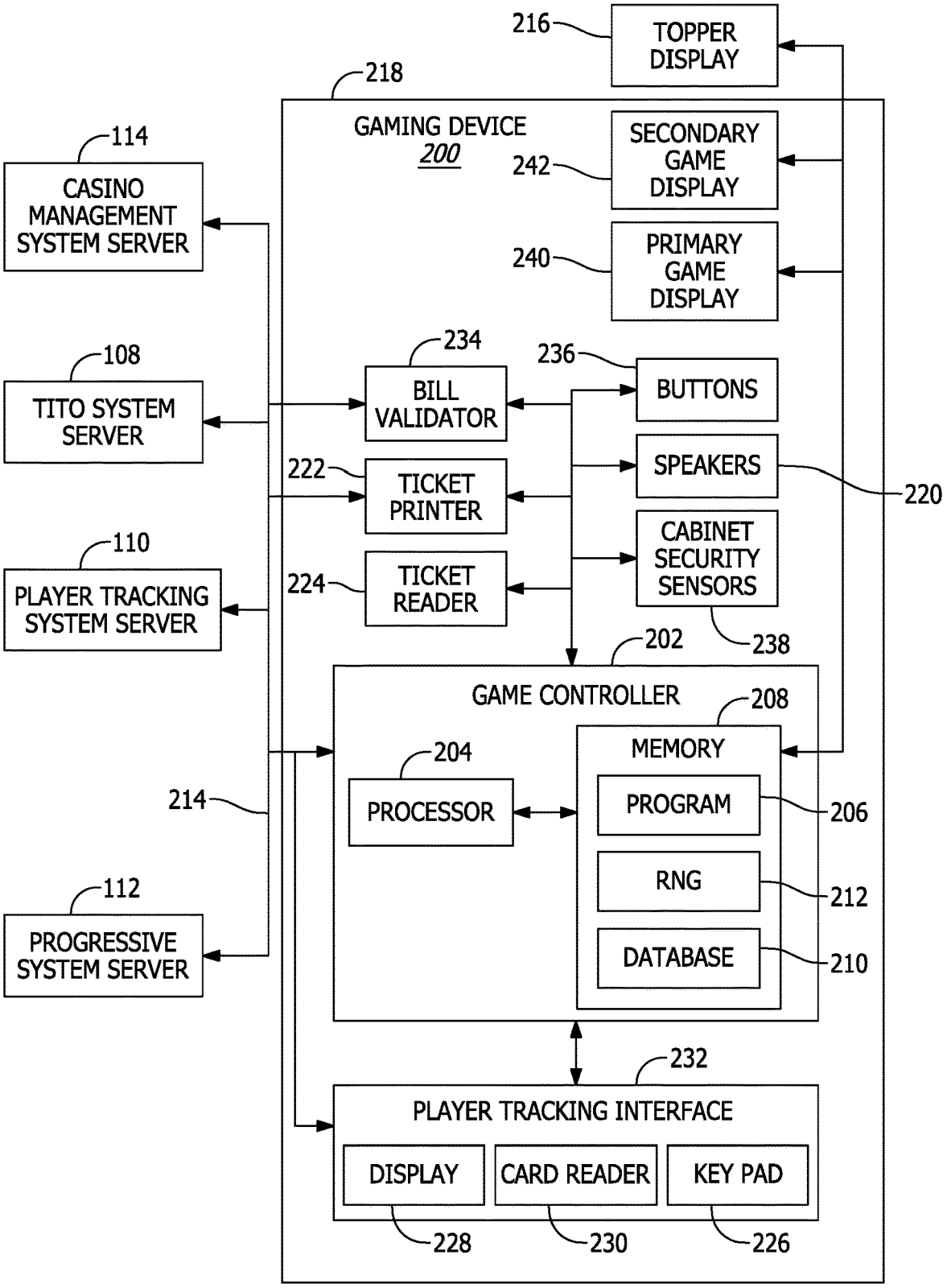
FIG. 2 is a block diagram of an exemplary gaming device.

Many or all of the above described components may be controlled by circuitry (e.g., a gaming controller) housed inside main cabinet 116 of gaming device 104A, the details of which are shown in FIG. 2.

Not all gaming devices suitable for implementing embodiments of the gaming systems, gaming devices, or methods described herein necessarily include top wheels, top boxes, information panels, cashless ticket systems, and/or player tracking systems. Further, some suitable gaming devices have only a single game display that includes only a mechanical set of reels and/or a video display, while others are designed, for example, for bar tables or table tops and have displays that face upwards.

Exemplary gaming device 104B shown in FIG. 1 is an Arc™ model gaming device manufactured by Aristocrat® Technologies, Inc. Where possible, reference numeral identifying similar features of gaming device 104A are also identified in gaming device 104B using the same reference numerals. Gaming device 104B, however, does not include physical reels 130 and instead shows game play and related game play functions on main display 128. An optional topper screen 140 may be included as a secondary game display for bonus play, to show game features or attraction activities while the game is not in play, or any other information or media desired by the game designer or operator. In some embodiments, topper screen 140 may also or alternatively be used to display progressive jackpot prizes available to a player during play of gaming device 104B.

Gaming device 104B includes main cabinet 116 having main door 118 that opens to provide access to the interior of gaming device 104B. Main door 118, or service door, is typically used by service personnel to refill ticket-out printer 126 and collect bills and tickets inserted into bill validator 124. Main door 118 may further be accessed to reset the machine, verify and/or upgrade the software, and for general maintenance operations.

Exemplary gaming device 104C shown in FIG. 1 is a Helix™ model gaming device manufactured by Aristocrat® Technologies, Inc. Gaming device 104C includes a main display 128A that is in a landscape orientation. Although not illustrated by the front view illustrated in FIG. 1, landscape display 128A has a curvature radius from top to bottom. In certain embodiments, display 128A is a flat panel display. Main display 128A is typically used for primary game play while a secondary display 128B is used for bonus game play, to show game features or attraction activities while the game is not in play, or any other information or media desired by the game designer or operator.

Many different types of games, including mechanical slot games, video slot games, video poker, video black jack, video pachinko, keno, bingo, and lottery, may be provided with or implemented within gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, Class II, or Class III, etc.

FIG. 2 is a block diagram of an exemplary gaming device 200, or EGM, connected to various external systems, including TITO system server 108, player tracking system server 110, progressive system server 112, and casino management system server 114. All or parts of gaming device 200 may be embodied in game devices 104A-104X shown in FIG. 1. The games conducted on gaming device 200 are controlled by a game controller 202 that includes one or more processors 204 and a memory 208 coupled thereto. Games are represented by game software or a game program 206 stored on memory 208. Memory 208 includes one or more mass storage devices or media housed within gaming device 200. One or more databases 210 may be included in one or more databases 210 for use by game program 206. A random number generator (RNG) 212 is implemented in hardware and/or software and is used, in certain embodiments, to generate random numbers for use in operation of gaming device 200 to conduct game play and to ensure the game play outcomes are random and meet regulations for a game of chance.

Alternatively, a game instance, or round of play of the game, may be generated on a remote gaming device such as central determination gaming system server 106, shown in FIG. 1. The game instance is communicated to gaming device 200 via a network 214 and is then displayed on gaming device 200. Gaming device 200 executes game software to enable the game to be displayed on gaming device 200. In certain embodiments, game controller 202 executes video streaming software that enables the game to be displayed on gaming device 200. Game software may be loaded from memory 208, including, for example, a read only memory (ROM), or from central determination gaming system server 106 into memory 208. Memory 208 includes at least one section of ROM, random access memory (RAM), or other form of storage media that stores instructions for execution by processor 204.

Gaming device 200 includes a topper display 216. In an alternative embodiment, gaming device 200 includes another form of a top box such as, for example, a topper wheel, or other topper display that sits on top of main cabinet 218. Main cabinet 218 or topper display 216 may also house various other components that may be used to add features to a game being played on gaming device 200, including speakers 220, a ticket printer 222 that prints bar-coded tickets, a ticket reader 224 that reads bar-coded tickets, and a player tracking interface 232*a*. Player tracking interface 232*a* may include a keypad 226 for entering player tracking information, a player tracking display 228 for displaying player tracking information (e.g., an illuminated or video display), and a card reader 230 for receiving data and/or communicating information to and from media or a device such as a smart phone enabling player tracking. Ticket printer 222 may be used to print tickets for TITO system server 108. Gaming device 200 may further include a bill validator 234, buttons 236 for player input, cabinet security sensors 238 to detect unauthorized opening of main cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered and time of play) for individual players so that an operator may reward players in a loyalty program. The player may use player tracking interface 232*a* to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by casino management system server 114.

Gaming devices, such as gaming devices 104A-104X and 200, are highly regulated to ensure fairness and, in many cases, gaming devices 104A-104X and 200 are operable to award monetary awards (e.g., typically dispensed in the form of a redeemable voucher). Therefore, to satisfy security and regulatory requirements in a gaming environment, hardware and software architectures are implemented in gaming devices 104A-104X and 200 that differ significantly from those of general-purpose computers. Adapting general purpose computers to function as gaming devices 200 is not simple or straightforward because (1) regulatory requirements for gaming devices, (2) harsh environments in which gaming devices operate, (3) security requirements, and (4) fault tolerance requirements. These differences require substantial engineering effort and often additional hardware.

When a player wishes to play gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances of the game. The credit balance is decreased by the amount of each wager and increased upon a win. The player can add additional credits to the balance at any time. The player may also optionally insert a loyalty club card into card reader 230. During the game, the player views the game outcome on game displays 240 and 242. Other game and prize information may also be displayed.

For each game instance, a player may make selections that may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using player-input buttons 236, primary game display 240, which may include a touch screen, or using another suitable device that enables a player to input information into gaming device 200.

During certain game events, gaming device 200 may display visual and auditory effects that can be perceived by the player. These effects add to the excitement of a game, which makes a player more likely to continue playing. Auditory effects include various sounds that are projected by speakers 220. Visual effects include flashing lights, strobing lights, or other patterns displayed from lights on gaming device 200 or from lights behind information panel 152, shown in FIG. 1.

When the player wishes to stop playing, he/she cashes out the credit balance (typically by pressing a cash out button to receive a ticket from ticket printer 222). The ticket may be "cashed-in" for money or inserted into another machine to establish a credit balance for play.

Figure 3:
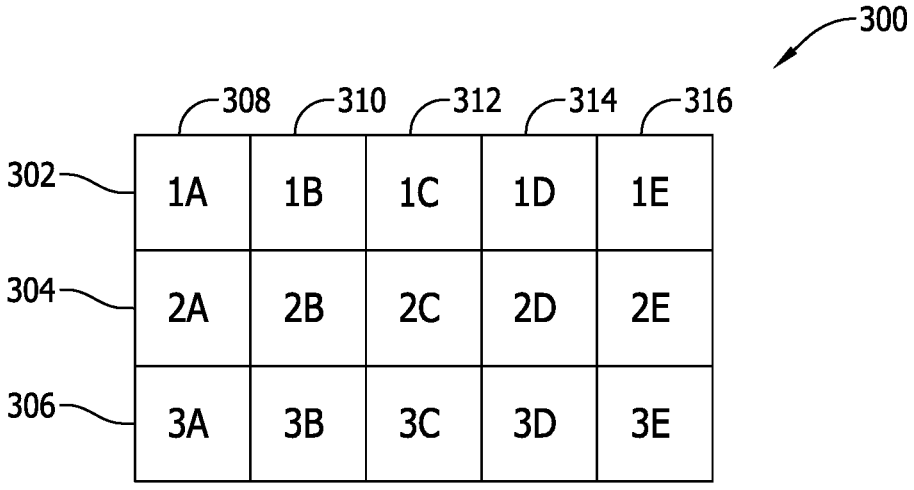
FIG. 3 is a schematic diagram of exemplary symbol positions in a matrix to be rendered on a display of the EGMs shown in FIGS. 1 and 2 during a primary game.

FIG. 3 is a schematic diagram of exemplary symbol positions in a matrix 300 to be rendered on a display of EGMs 104A-104X and 200 shown in FIGS. 1 and 2, respectively, during a primary game. For example, EGM 200 renders matrix 300 on primary game display 240. In alternative embodiments, matrix 300 may be rendered on secondary game display 242 or any other suitable display. Matrix 300 includes rows 302, 304, and 306, and columns 308, 310, 312, 314, and 316. Matrix 300 is illustrated as three rows and five columns. In alternative embodiments, matrix 300 may have one or more row and three or more columns. Matrix 300 includes fifteen symbol positions. Referring to FIG. 3, each symbol position is designated by a row number (e.g., 1, 2, and 3) and a column letter (e.g., A, B, C, D, and E). For example, the upper-left-most symbol position, or row 302 and column 308, is designated symbol position "1A." Further, for example, the symbol positions in column 314 are designated symbol positions 1D, 2D, and 3D.

Each of columns 308, 310, 312, 314, and 316 corresponds to a respective reel strip. A reel strip is a set of symbols (not shown) defined in memory, such as memory 208 shown in FIG. 2, and arranged in a defined sequence to further define a virtual reel that is spun and stopped to conduct the primary game. Matrix 300 includes the portions of the respective reel strips corresponding to columns 308, 310, 312, 314, and 316 that are visible to a player at the EGM. When conducting the primary game, a game controller, such as game controller 202 shown in FIG. 2, initiates and controls a spin of the virtual reels defined by the reel strips corresponding to and at least partially visible in columns 308, 310, 312, 314, and 316. When the game controller stops the virtual reels, a subset of the symbols on each reel strip is displayed in the symbol positions of matrix 300. Generally, the symbols populating a given reel strip are different, and each reel strip may assume a unique sequence of symbols. The symbols populating a given reel strip may be chosen randomly, chosen according to a predetermined algorithm, or fixed. The symbols, in certain embodiments, include special symbols such as, for example, wild symbols or other symbols that may trigger certain game features.

Figure 4:
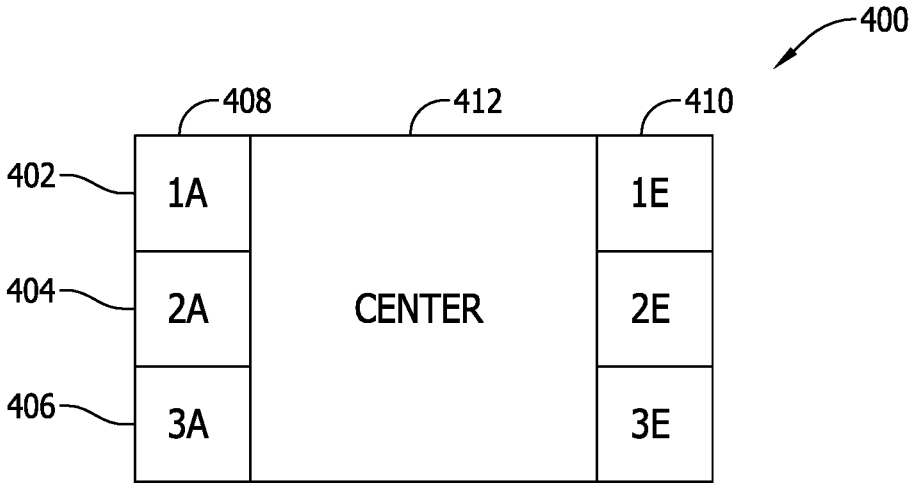
FIG. 4 is a schematic diagram of exemplary symbols positions in a matrix to be rendered on a display of the EGMs shown in FIGS. 1 and 2 during a secondary game.

FIG. 4 is a schematic diagram of exemplary symbols positions in a matrix 400 to be rendered on a display of EGMs 104A-104X and 200 shown in FIGS. 1 and 2, respectively, during a secondary game. For example, EGM 200 renders matrix 400 on primary game display 240. In alternative embodiments, matrix 400 may be rendered on secondary game display 242 or any other suitable display. Matrix 400 includes rows 402, 404, and 406, and columns 408, 410, and 412. Notably distinct from matrix 300 shown in FIG. 3, column 412 is a center column that spans the combined columns 310, 312, and 314 of matrix 300. Accordingly, where matrix 300 is illustrated as three rows and five columns, matrix 400 is illustrated as three rows and three columns. In alternative embodiments, similar to matrix 300, matrix 400 may have one or more row and two or more columns, one of which is a combined column that spans two or more columns from matrix 300. Further, in alternative embodiments, combined column 412 may be repositioned horizontally such that it does not stand in the exact location of combined columns 310, 312, and 314. For example, column 412 may be positioned to the far-left or far-right, whereas columns 310, 312, and 314 are in the center of matrix 300. In another alternative embodiment, combined column 412 may represent a combination of columns other than 310, 312, and 314. More specifically, column 412 represents a combination of any two or more of columns 308, 310, 312, 314, and 316. In certain embodiments, the combined columns are not necessarily adjacent. For example, columns 308 and 314 may be combined into column 412 and positioned accordingly with respect to columns 310, 312, and 316, which would further correspond to columns 408, 410, and another column (not shown).

Referring again to FIG. 4, matrix 400 includes seven symbol positions in the matrix. Each symbol position is designated by a row number (e.g., 1, 2, and 3) and a column designation (e.g., A, E, and center). Column 408 is designated as column "A," while column 410 is designated as column "E," which correspond to columns 308 and 316, respectively, of matrix 300. Column 412 is simply designated "center," without a row designation.

Matrices 300 and 400 are selectively displayed on one or more displays of EGMs 104A-104X and 200 shown in FIGS. 1 and 2. "Selectively displayed" refers to the selection, by game controller 202, to display one or both of matrices 300 and 400 on a display device, such as, for example, primary game display 240 or secondary game display 242, or any other suitable display. Further, by implication, selectively displaying matrices 300 and 400 means neither is necessarily persistently displayed. Rather, it is only by selection, or by choice, e.g., by game controller 202, that matrix 300, matrix 400, or both may be displayed. For example, in one embodiment, when selectively displaying matrix 300, game controller 202 controls a display device to render matrix 300 and matrix 400 is not rendered on the display. Likewise, when selectively displaying matrix 400, e.g., when the secondary game is triggered, game controller 202 controls a display device to render matrix 400 and matrix 300 is not rendered on the display. In other words, matrices 300 and 400 are rendered in an alternating fashion, not concurrently, and not necessarily periodically. In alternative embodiments, matrices 300 and 400 may be selectively displayed concurrently on a display device under certain circumstances. In such an embodiment, game controller 202 selects to render matrix 300 and also selects to render matrix 400.

Figure 5:
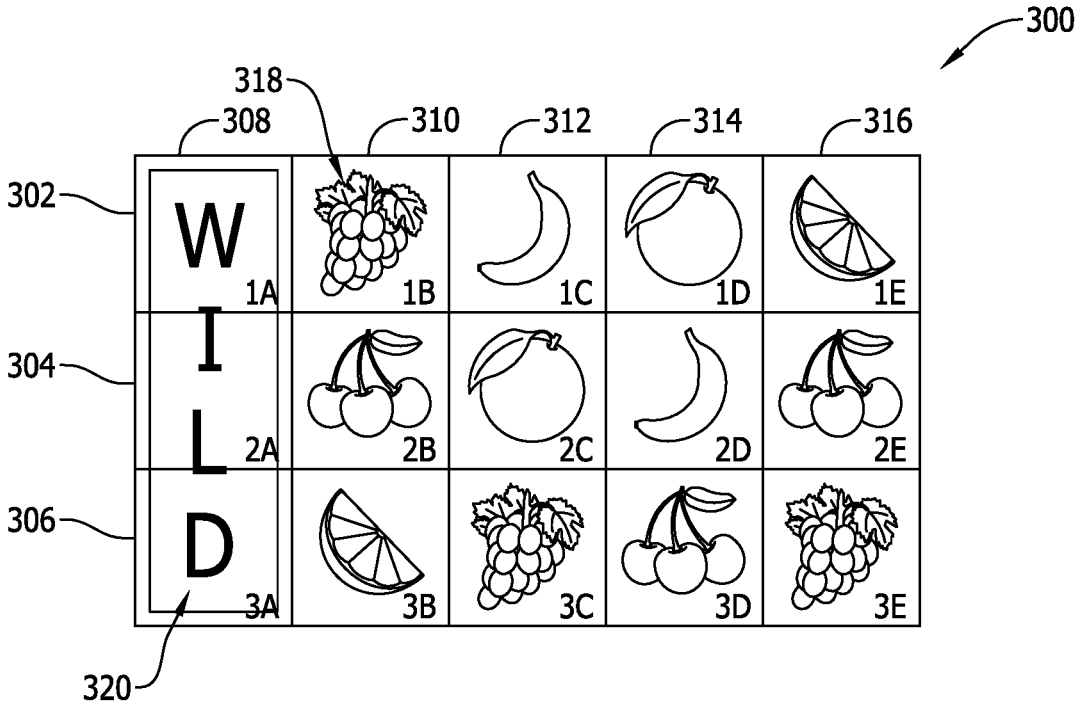
FIG. 5 is a schematic diagram of another exemplary matrix to be rendered on a display of the EGMs shown in FIGS. 1 and 2, and illustrating a trigger condition during a primary game.

FIG. 5 is a schematic diagram of matrix 300 illustrating a trigger condition during the primary game. In certain embodiments, symbols 318, indicated by the various shapes and/or objects depicted at each symbol position, populating at least one of the reel strips corresponding to columns 308, 310, 312, 314, and 316 include one or more wild symbol 320 that is oversized vertically, that is, wild symbol 320 spans three consecutive symbol positions on the reel strip. The term "symbols 318" refers generally to the various symbols displayed in matrix 300 or matrix 400. For clarity, in FIG. 5, for example, only the symbol in symbol position 1B is identified as a "symbol 318." However, it should be understood that each of the various symbols appearing in the symbol positions of columns 310, 312, 314, and 316 may be referred to as symbols 318. The same is true for all subsequent figures.

In the embodiment of FIG. 5, the reel strip corresponding to column 308 of matrix 300 includes one or more oversized wild symbol 320. During the primary game, when the virtual reel defined by the reel strip corresponding to column 308 is stopped, and wild symbol 320 appears and spans each of rows 302, 304, and 306, a feature is triggered. The occurrence of wild symbol 320 in column 308 is referred to as a trigger condition. In certain embodiments, wild symbol 320 may also be included in respective reel strips corresponding to one or more of columns 310, 312, 314, and 316. Further, in certain embodiments, the occurrence of wild symbol 320 in one or more of columns 310, 312, 314, and 316 may also be defined as a trigger condition. In the embodiment of FIG. 5, the trigger condition is limited to the occurrence of wild symbol 320 in column 308 or column 316.

Figure 6:
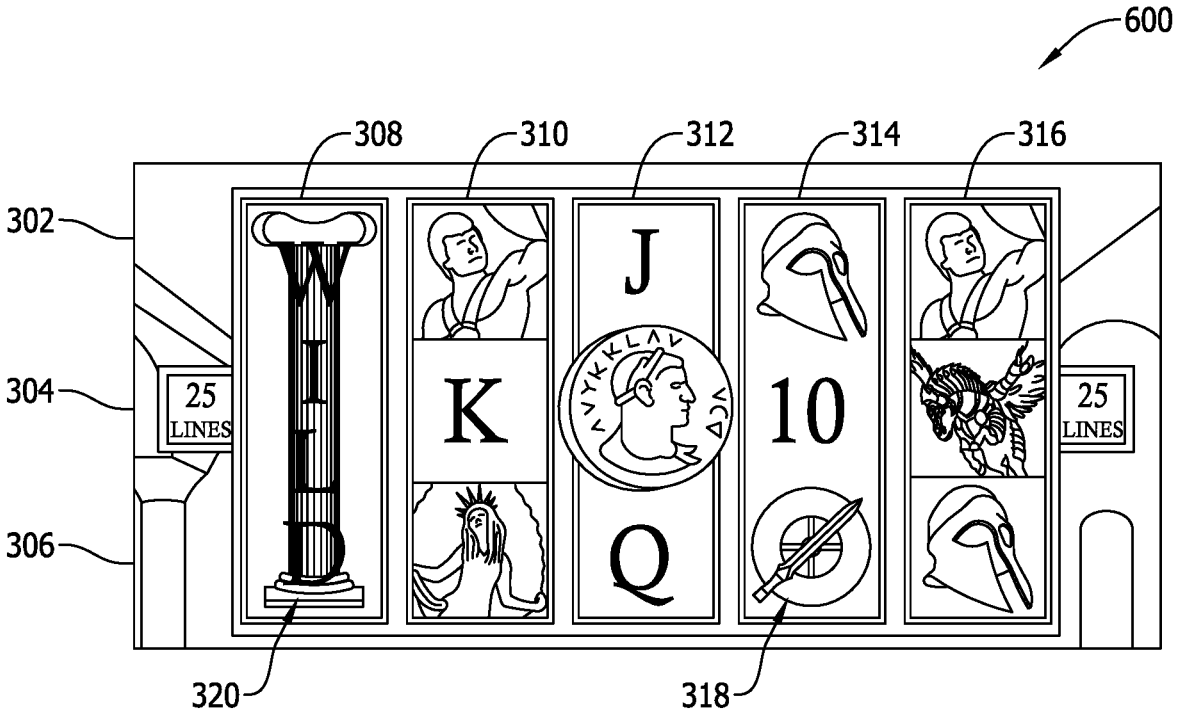
FIG. 6 is a graphical illustration of an exemplary matrix of the Pillars of Perseus game in which a trigger condition occurs during a primary game.

FIG. 6 is a graphical illustration of an exemplary matrix 600 of the Pillars of Perseus game in which a trigger condition occurs during a primary game. Matrix 600, like matrix 300, includes rows 302, 304, 306 and columns 308, 310, 312, 314, 316. The reel strips corresponding to columns 308, 310, 312, 314, and 316 include various symbols 318 and, in particular, the reel strips corresponding to columns 308 and 316 include at least one wild symbol 320 that spans three rows on the reel strip. During the primary game, when, as illustrated in FIG. 6, wild symbol 320 appears in either of columns 308 and 316 and spans each of rows 302, 304, and 306, the Pillar Pays secondary game is triggered, or enabled.

Figure 7:
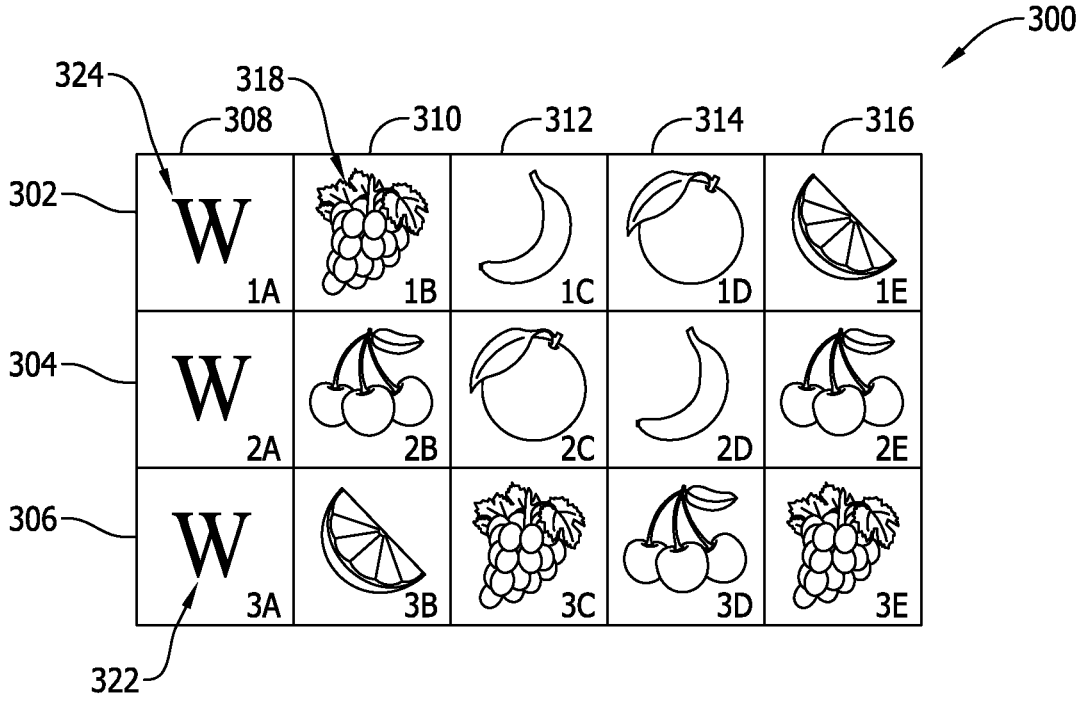
FIG. 7 is a schematic diagram of another exemplary matrix to be rendered on a display of the EGMs shown in FIGS. 1 and 2, and illustrating an alternative trigger condition during a primary game.

FIG. 7 is a schematic diagram of matrix 300 illustrating an alternative trigger condition during the primary game. In certain embodiments, symbols 318 populating at least one of the reel strips corresponding to columns 308, 310, 312, 314, and 316 include two or more wild symbols 322, designated as "W," arranged in a stack 324, or a consecutive grouping of wild symbols 322 within the reel strip. In the embodiment of FIG. 7, the reel strip corresponding to column 308 of matrix 300 includes one or more stacks 324 of wild symbol 322. During the primary game, when the virtual reel defined by the reel strip corresponding to column 308 is stopped, and stack 324 appears and spans each of rows 302, 304, and 306, a feature is triggered. The occurrence of stack 324 in column 308 is referred to as a trigger condition. In certain embodiments, stacks 324 of wild symbol 322 may also be included in respective reel strips corresponding to one or more of columns 310, 312, 314, and 316. Further, in certain embodiments, the occurrence of stack 324 in one or more of columns 310, 312, 314, and 316 may also be defined as a trigger condition. In the embodiment of FIG. 7, the trigger condition is limited to the occurrence of stack 324 of wild symbols 322 in column 308 or column 316.

Figure 8:
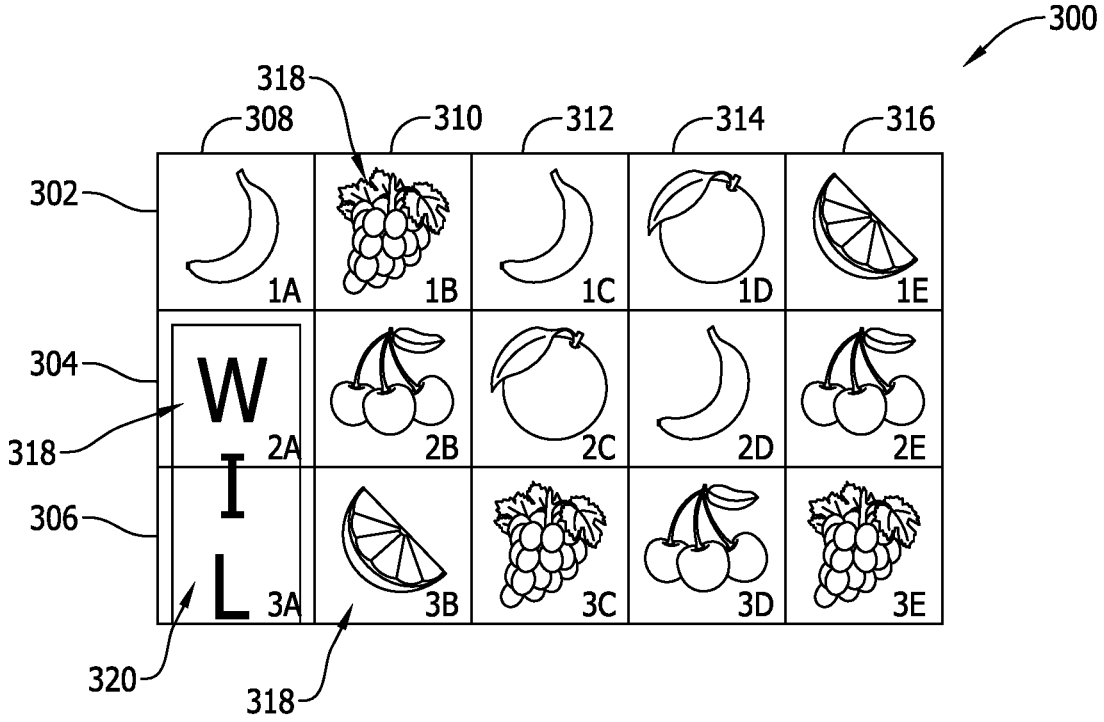
FIG. 8 is a schematic diagram of yet another exemplary matrix to be rendered on a display of the EGMs shown in FIGS. 1 and 2, and illustrating another alternative trigger condition during a primary game.
Figure 9:
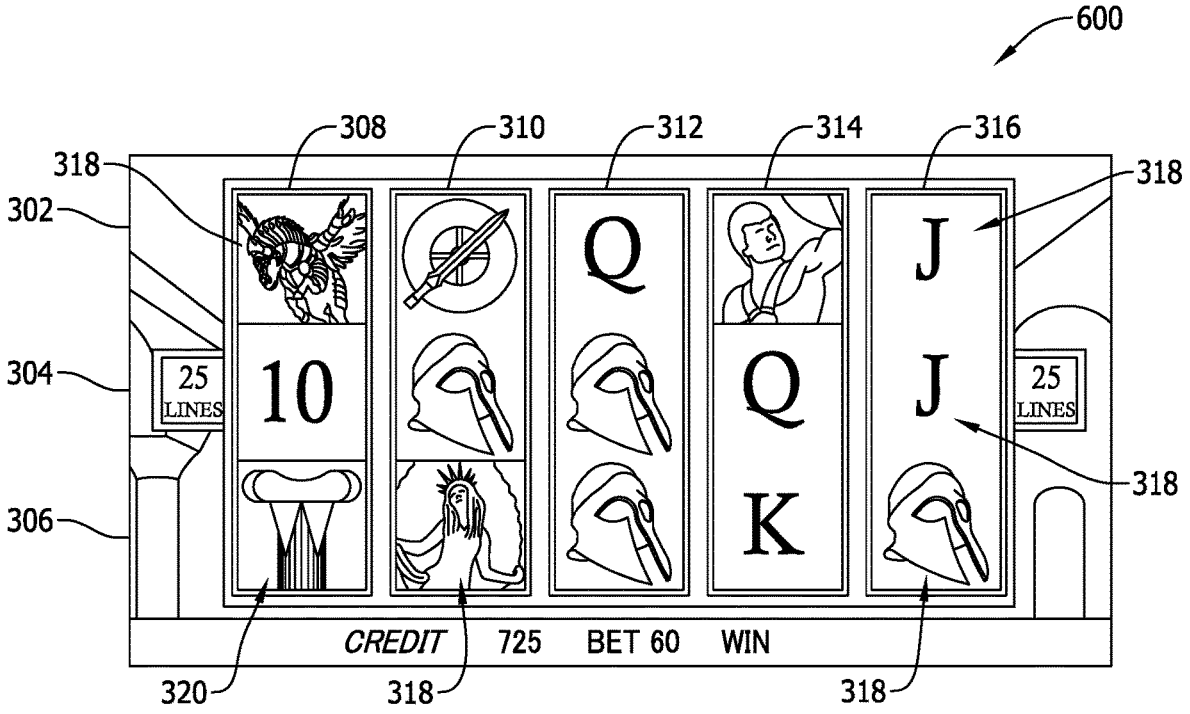
FIG. 9 is a graphical illustration of an exemplary matrix of the Pillars of Perseus game in which an alternative trigger condition occurs during a primary game.

FIG. 8 is a schematic diagram of matrix 300 illustrating yet another alternative trigger condition during a primary game. Referring again to the embodiment of FIG. 5, the reel strips corresponding to columns 308 and 316 of matrix 300 includes one or more oversized wild symbol 320. During the primary game, when the virtual reels defined by the reel strips corresponding to columns 308 and 316 are stopped, wild symbol 320 may appear and only partially span rows 302, 304, and 306. For example, as shown in FIG. 8, wild symbol 320 appears in column 308, but only spans rows 304 and 306, and an additional symbol appears in symbol position 1E. Likewise, in the Pillars of Perseus game, as shown in FIG. 9, which shows a graphical illustration of an exemplary matrix of the Pillars of Perseus game, wild symbol 320 appears only partially in column 308, i.e., spanning only row 306, when the virtual reel defined by the reel strip corresponding to column 308 is stopped.

Figure 10:
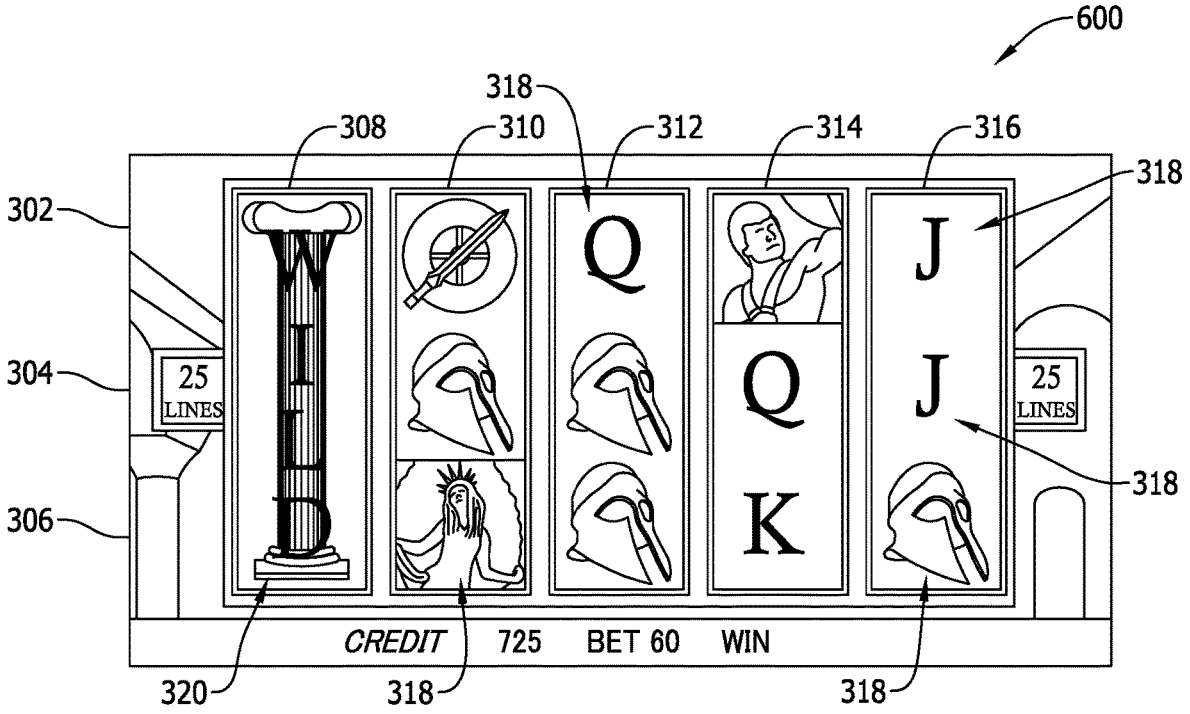
FIG. 10 is a graphical illustration of an exemplary matrix of the Pillars of Perseus game in which the alternative trigger condition shown in FIG. 9 is achieved.

In certain embodiments, the occurrence of wild symbol 320 in this manner results in "nudging," or shifting, of the reel strip corresponding to column 308 or, in alternative embodiments, column 316, to fully display wild symbol 320 such that it spans each of rows 302, 304, and 306. Accordingly, after the nudging, the occurrence of wild symbol 320 satisfies the trigger condition defined in the embodiment of FIG. 5. For example, in the Pillars of Perseus game, FIG. 10 is a graphical illustration of matrix 600 after nudging the wild symbol 320 that appeared only partially in matrix 600 illustrated in FIG. 9. Likewise, in certain embodiments, the nudging feature may also be applied to the appearance of a partial stack 324, i.e., an occurrence where only one or two of wild symbols 322 in stack 324 appear in column 308 or, in alternative embodiments, column 316. The nudging feature would then result in a full stack 324 appearing in column 308 or, in alternative embodiments, column 316, such that wild symbol 322 is displayed in each of rows 302, 304, and 306, thereby satisfying the trigger condition defined in the embodiment of FIG. 7.

Figure 11:
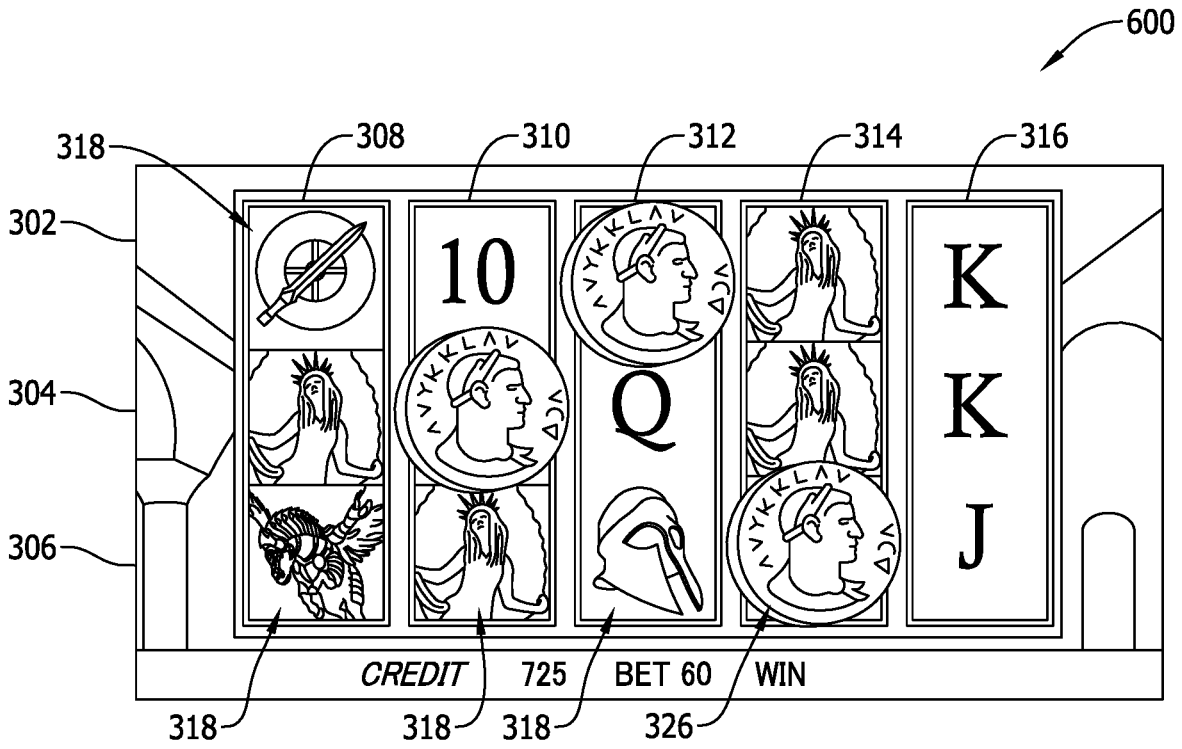
FIG. 11 is a graphical illustration of an exemplary matrix of the Pillars of Perseus game in which another trigger condition occurs during a primary game.

In certain embodiments, the nudging feature illustrated in FIG. 8 is always active and will result in the trigger condition being satisfied more frequently. In alternative embodiments, the nudging feature may only be activated during a bonus game or upon the satisfaction of some other trigger condition such as, for example, a wager exceeding a given threshold, the appearance of a threshold number of symbols in the primary game, or achieving a particular payline, among others. FIG. 11 is a graphical illustration of matrix 600 of the Pillars of Perseus game in which another trigger condition occurs during a primary game. For example, the reel strips corresponding to columns 308, 310, 312, 314, 316 include special symbols 326 that, when appearing in the matrix and numbering three or more, trigger a bonus game, or "free game bonus," in which the nudging feature is enabled for one or more subsequent spins of the virtual reels defined by the reel strips. In certain embodiments, the nudging feature is enabled for all spins of the virtual reels within the bonus game. FIG. 11 illustrates the occurrence of such a trigger condition, where three special symbols 326 appear scattered among columns 310, 312, and 314.

Figure 12:
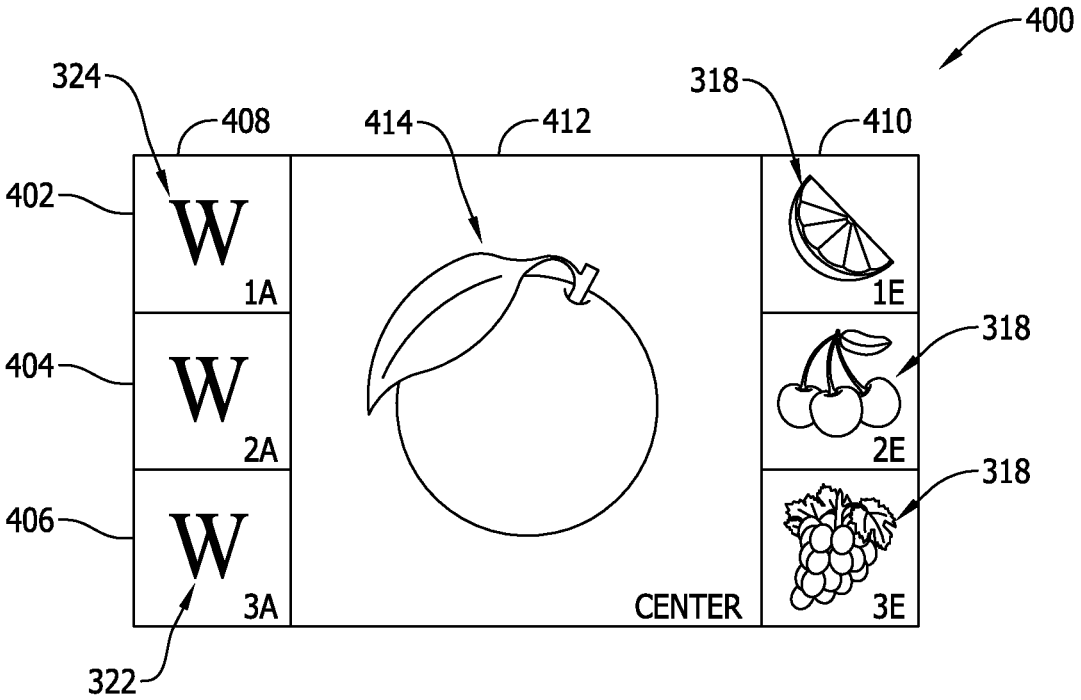
FIG. 12 is a schematic diagram of an exemplary matrix to be rendered on a display of the EGMs shown in FIGS. 1 and 2, and illustrating oversized symbols during a secondary game.

FIG. 12 is a schematic diagram of matrix 400, shown in FIG. 4, during a secondary game. Each of columns 408, 410, and 412 corresponds to a respective reel strip. The reel strips corresponding to columns 408 and 410 are populated with symbols 318, as in the primary game conducted on matrix 300, shown, for example, in FIGS. 3 and 5-11. The reel strip corresponding to column 412 is populated with oversized symbols 414 that span the vertical and horizontal space of rows 402, 404, and 406, and column 412, which itself spans the horizontal space of columns 310, 312, and 314 of matrix 300. The reel strip corresponding to column 412 is distinct from the reel strips corresponding to any of columns 408 and 410, or columns 308, 310, 312, 314, and 316 of matrix 300.

The secondary game is conducted upon satisfying the trigger conditions in the primary game described above with respect to FIGS. 5, 7, and 8, and as shown in FIGS. 6 and 9-11. For example, the secondary game is initiated upon a full stack 324 of wild symbols 322 appearing in column 308 or 316. In certain embodiments, the triggering symbols, i.e., stack 324, from the primary game remains fixed in column 408 or 410 on matrix 400 during the play of the secondary game. In alternative embodiments, the virtual reel on which the triggering symbol or symbols appear will spin with the other virtual reels during the secondary game.

Figure 13:
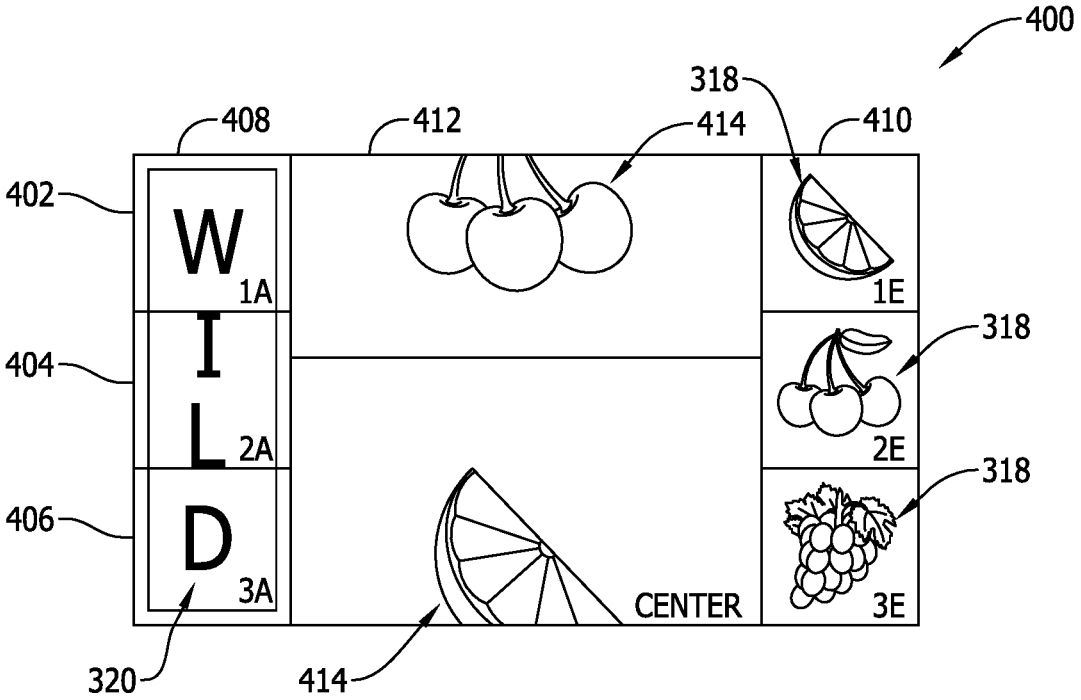
FIG. 13 is a schematic diagram of an exemplary matrix to be rendered on a display of the EGMs shown in FIGS. 1 and 2, and illustrating oversized symbols during a spin of a secondary game.

When conducting the secondary game, a game controller, such as game controller 202 shown in FIG. 2, initiates and controls a spin of the virtual reels defined by the reel strips corresponding to and at least partially visible in columns 408, 410, and 412. FIG. 13 is a schematic diagram of matrix 400 during a spin of the secondary game. FIG. 13 illustrates oversized symbols 414 "spinning" through column 412 in the matrix defined by matrix 400. Further, FIG. 13 illustrates a triggering wild symbol 320 in column 408 that is fixed while the virtual reels corresponding to columns 412 and 410 spin.

Figure 14:
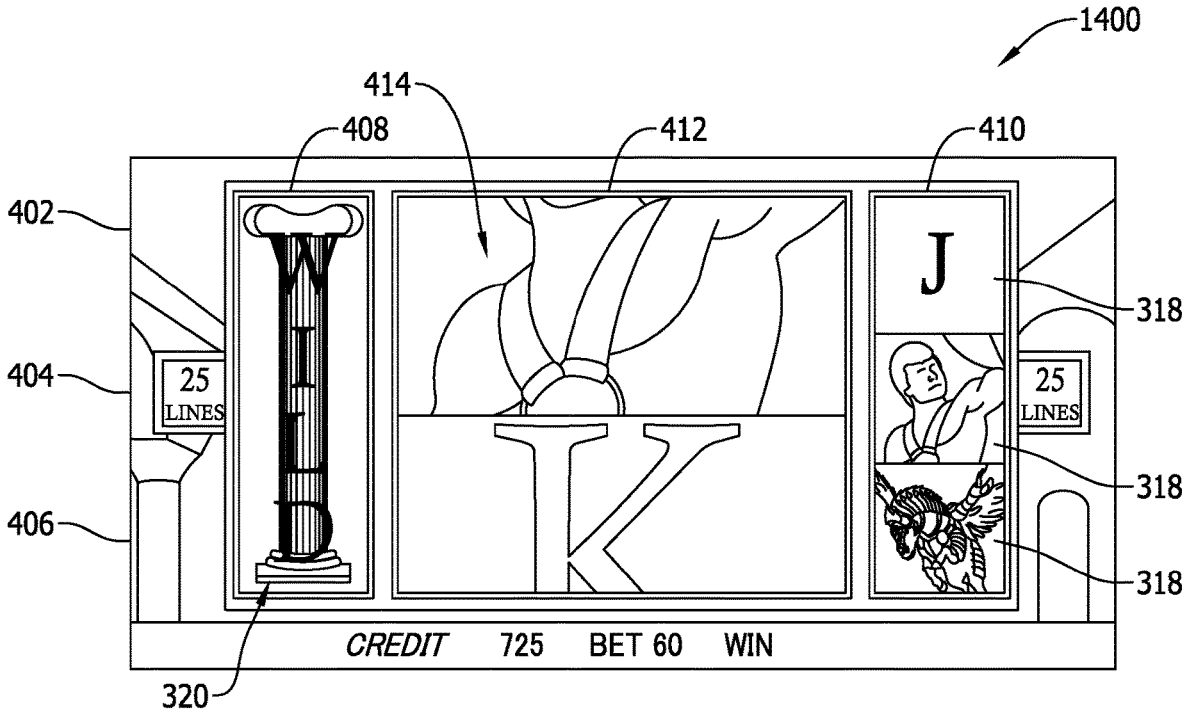
FIG. 14 is a graphical illustration of an exemplary matrix of the Pillars of Perseus game in which the Pillar Pays secondary game is enabled.
Figure 15:
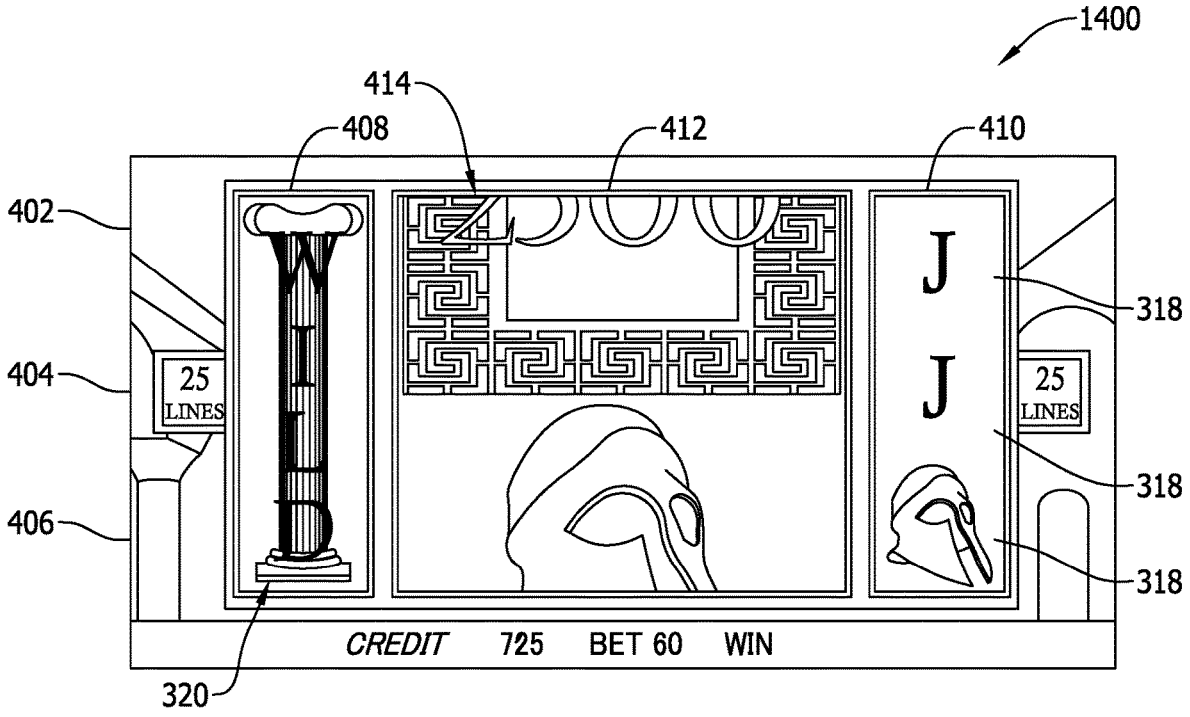
FIG. 15 is a graphical illustration of an exemplary matrix of the Pillars of Perseus game in which the Pillar Pays secondary game is enabled.
Figure 16:
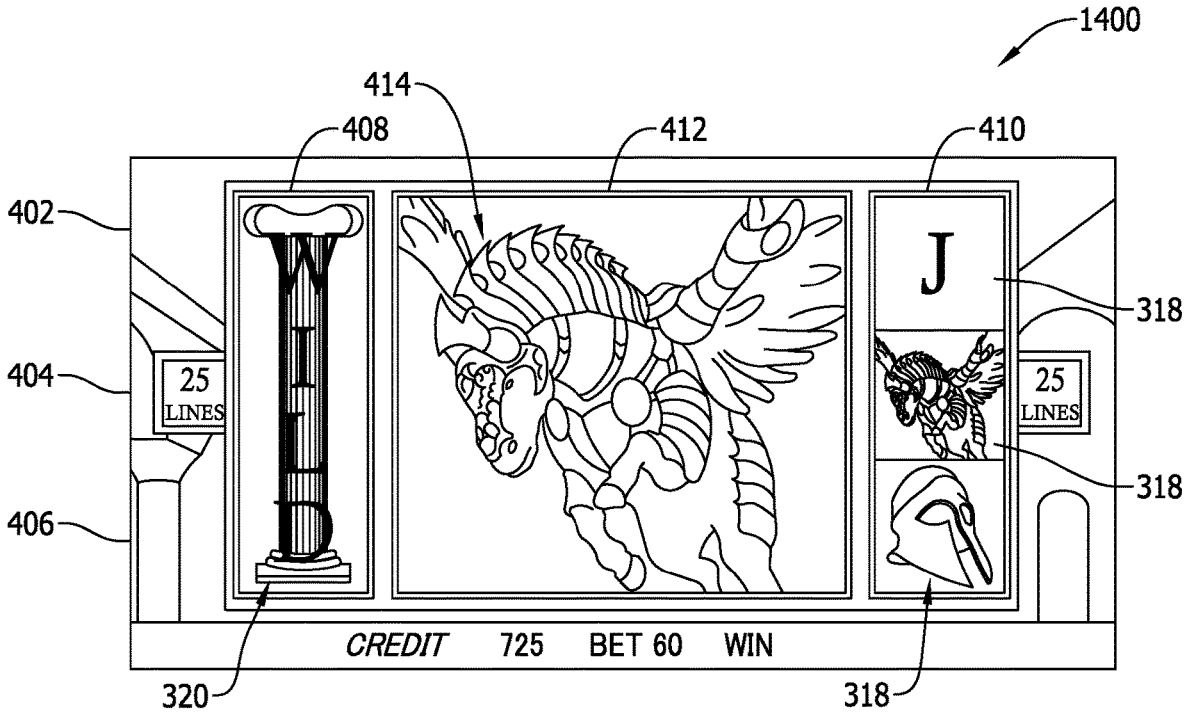
FIG. 16 is a graphical illustration of an exemplary matrix of the Pillars of Perseus game in which the Pillar Pays secondary game is enabled.
Figure 17:
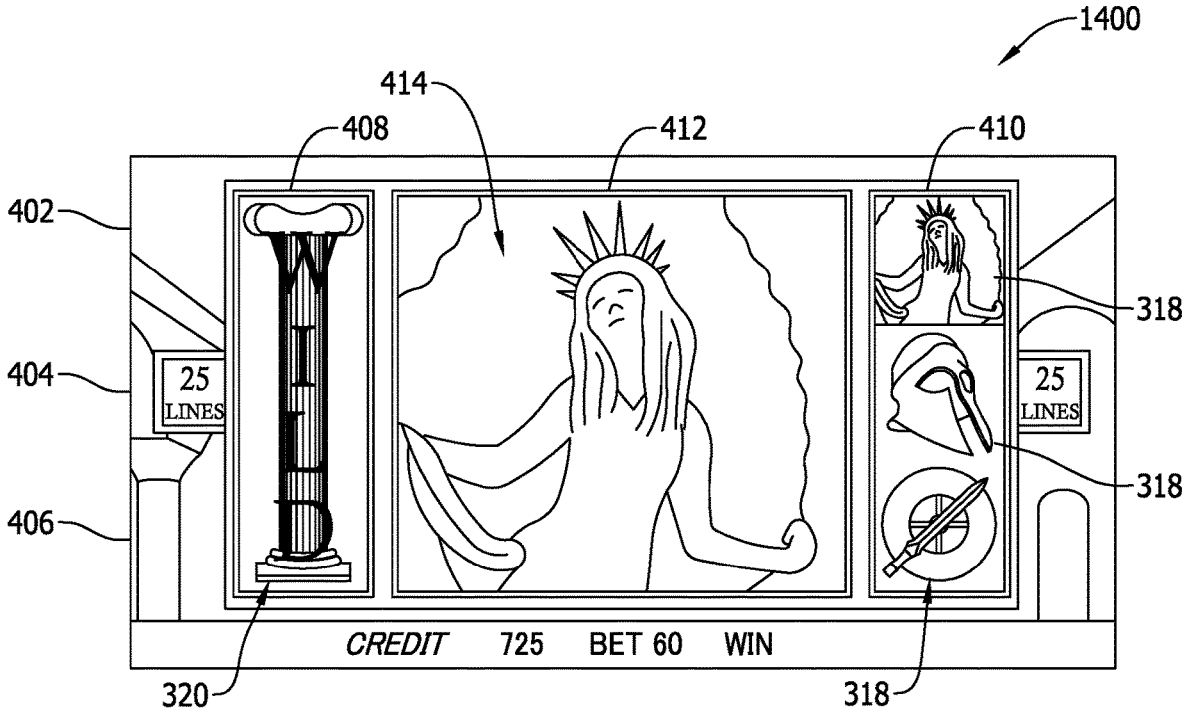
FIG. 17 is a graphical illustration of an exemplary matrix of the Pillars of Perseus game in which the Pillar Pays secondary game is enabled.
Figure 18:
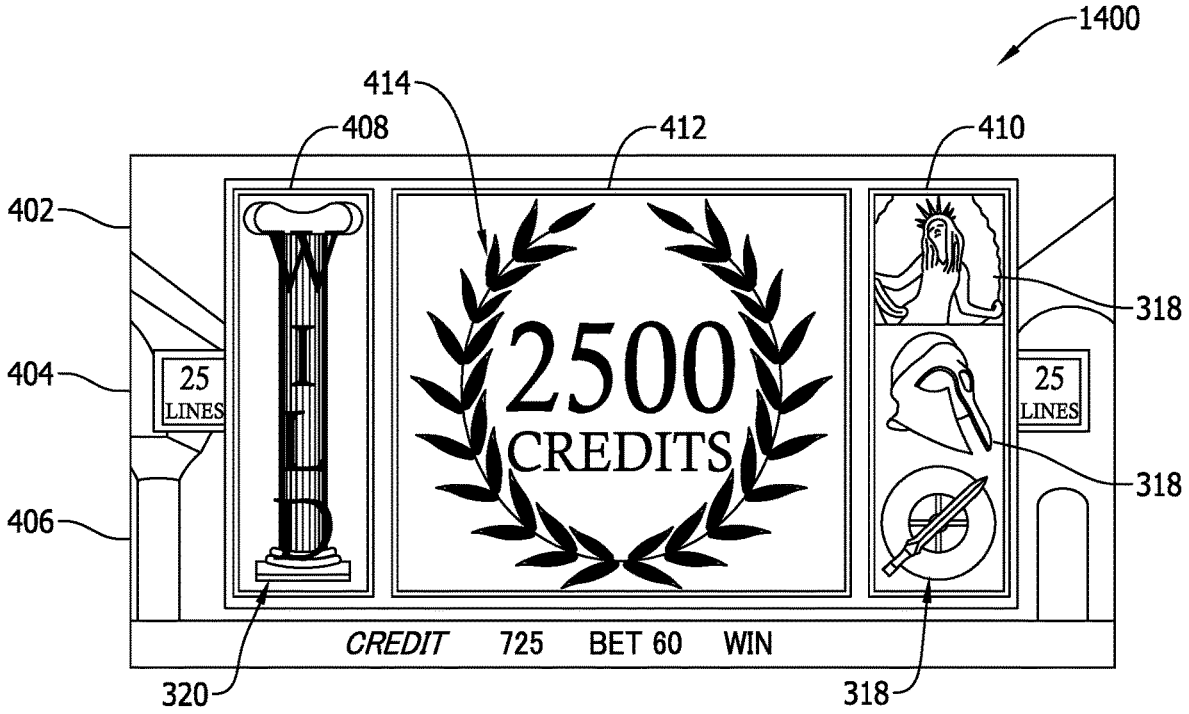
FIG. 18 is a graphical illustration of an exemplary matrix of the Pillars of Perseus game in which the Pillar Pays secondary game is enabled.
Figure 19:
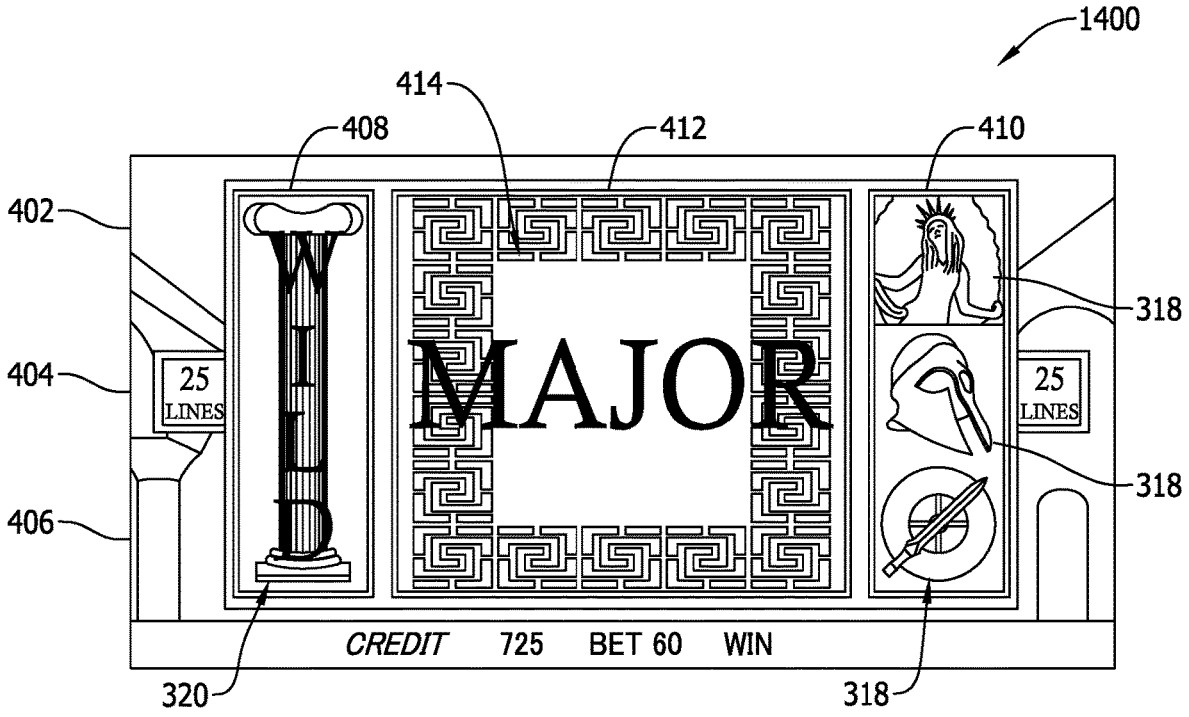
FIG. 19 is a graphical illustration of an exemplary matrix of the Pillars of Perseus game in which the Pillar Pays secondary game is enabled.

FIG. 14 is a graphical illustration of an exemplary matrix 1400 of the Pillars of Perseus game in which the Pillar Pays secondary game is enabled. As in matrix 400, shown in FIG. 4, matrix 1400 includes rows 402, 404, and 406, and columns 408, 410, and 412, including the combined column 412 that corresponds to the "mega reel" on which oversized symbols 414 are displayed. FIG. 15 is another graphical illustration of matrix 1400 of the Pillars of Perseus game in which the Pillar Pays secondary game is enabled. FIGS. 14 and 15 each illustrate the Pillar Pays secondary game during a spin of the virtual reels defined by the reel strips corresponding to columns 408, 410, and 412. As in FIG. 13, oversized symbols 414 spin through column 412 in matrix 1400. Further, FIGS. 14 and 15 each illustrate a triggering wild symbol 320 in column 408 that is fixed while the virtual reels corresponding to columns 410 and 412 spin.

Referring again to FIG. 12, when the game controller stops the virtual reels, respective subsets of symbols 318 on reel strips corresponding to columns 408 and 416 are displayed in the symbol positions of matrix 400. Additionally, when the virtual reel corresponding to column 412 is stopped, at least one oversized symbol 414 is displayed in column 412. In certain embodiments, only a single full oversized symbol 414 is displayed in column 412 when the virtual reel corresponding to column 412 is stopped. FIGS. 16-19 are graphical illustrations of matrix 1400 of the Pillars of Perseus game in which the Pillar Pays secondary game is enabled. Each of FIGS. 16-19 illustrates different potential reel-stops of the virtual reels defined by the reel strips corresponding to columns 408, 410, 412, including different combinations of symbols 318, 320, and 414. Symbols 318, 320, and 414 appearing in matrix 400 or 1400 are then evaluated against one or more paylines defined for the secondary game. Based on this evaluation, the outcome of the secondary game may result in awarding a monetary prize, free game rounds, perks, bonuses, or any other suitable award. Monetary prizes may include one or more tiers of jackpots or progressive awards. For example, in the Pillar Pays secondary game illustrated in FIGS. 18 and 19, evaluation of symbols 318, 320, and 414 results in an award of a 2500 credit bonus or a "major" jackpot, respectively.

Figure 20:
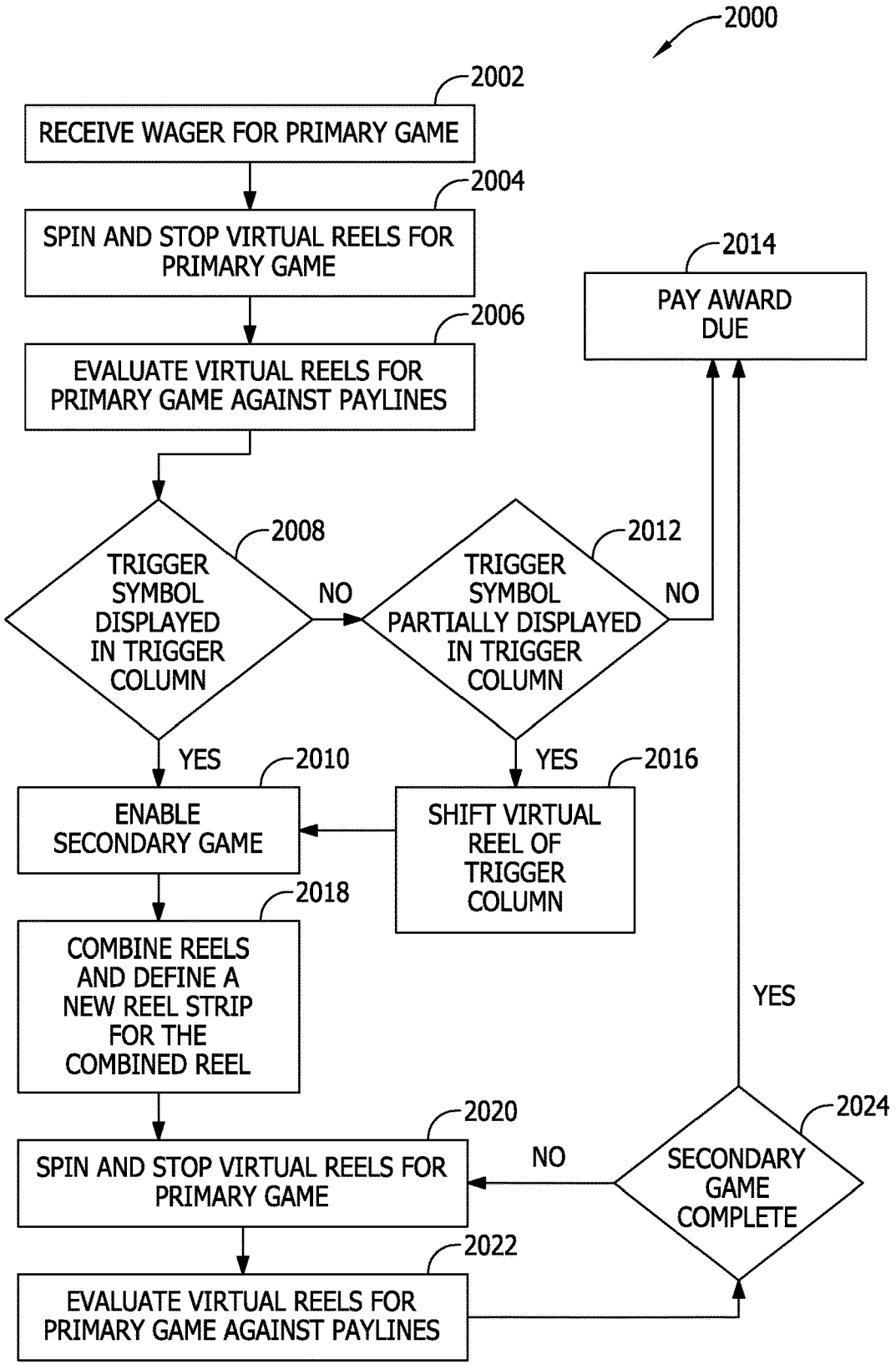
FIG. 20 is a flow diagram of another exemplary method of conducting a primary game and a secondary game on an electronic gaming machine.

FIG. 20 is a flow diagram of another method 2000 of conducting a primary game and a secondary game on an electronic gaming machine, such as EGM 104A-104X, or 200 shown in FIGS. 1 and 2, respectively. Method 2000 begins with receiving a wager 2002 to initiate the primary game. To conduct the primary game, a plurality of virtual reels for the primary game is spun and stopped 2004. The respective symbols of the virtual reels appearing in the primary matrix are evaluated 2006 against paylines for the primary game to determine a win or loss, and further to determine any potential award.

The symbols appearing in the primary matrix are further evaluated to determine 2008 whether a trigger symbol is displayed in a trigger column. If yes, the secondary game is enabled 2010, for example, for a single spin. In alternative embodiments, the secondary game is enabled 2010 for multiple spins. If not, in certain embodiments, the symbols are evaluated to determine 2012 whether a trigger symbol is only partially displayed in the trigger column. In such embodiments, if no such trigger symbol is displayed, method 2000 proceeds to paying 2014 any award due based on the primary game and returns to wait receipt 2002 of another wager for the primary game. If a trigger symbol is partially displayed, as is shown, for example, in FIG. 8, the virtual reel corresponding to the trigger column is shifted 2016, or nudged, to make the trigger symbol fully displayed, thereby triggering, or enabling 2010, the secondary game.

Once the secondary game is enabled 2010, the matrix is reconfigured into a secondary matrix, where certain reels are combined 2018 and a new reel strip is defined for the combined reel. For example, in the embodiments of FIGS. 3, 5, 7, and 8, matrix 300 is defined as a three row-five column matrix, where columns 308 and 316 (left-most and right-most) are trigger columns, and columns 310, 312, and 314 are combinable columns. Matrix 400, for the secondary game, is defined as having trigger columns 408 and 410, corresponding to trigger columns 308 and 316 in matrix 300 for the primary game. Matrix 400 also has combined column 412 that represents a combination of columns 310, 312, and 314. The reel strip corresponding to combined column 412 is populated with oversized symbols that span both the vertical and horizontal space of columns 310, 312, and 314, and rows 302, 304, and 306.

During the secondary game, the virtual reels for the secondary game are spun and stopped 2020. The symbols displayed on the virtual reels for the secondary game are then evaluated 2022 against paylines for the secondary game. In certain embodiments, a single round of play is award in the secondary game. In certain other embodiments, multiple rounds of play may be awarded in the secondary game. The quantity of rounds of play awarded for the secondary game may depend at least partially on the initial wager in the primary game, the outcome of the primary game, the triggering symbol, and outcomes in prior rounds of the secondary game itself. Once the symbols displayed on the virtual reels for the secondary game are evaluated, a determination 2024 is made as to whether the secondary game is complete, i.e., the player has exhausted their rounds of play in the secondary game. If not, the virtual reels for the secondary game are spun and stopped 2020 again. If the secondary game is complete, method 2000 proceeds to paying 2014 any awards due from the secondary game or the primary game, and then further proceeds to wait for receipt 2002 of a wager for the primary game.

In alternative embodiments, additional or fewer components may be incorporated into method 2000. Moreover, the ordering of certain elements may vary from implementation to implementation. For example, evaluation of symbols in the primary game may occur before or after determining whether a trigger symbol is present. Such variations are within the scope of the embodiments described herein.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data in a non-transitory manner. Such memory, sometimes referred to as "non-transitory memory," includes a random access memory (RAM), read-only memory (ROM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As indicated above, the process may be embodied in computer software. The computer software could be supplied in a number of ways, for example on a tangible, non-transitory, computer readable storage medium, such as on any nonvolatile memory device (e.g. an EEPROM). Further, different parts of the computer software can be executed by different devices, such as, for example, in a client-server relationship. Persons skilled in the art will appreciate that computer software provides a series of instructions executable by the processor.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming machine comprising:

a display device;

a game controller; and a memory device storing instructions, which when executed by the game controller, cause the game controller to at least:

cause the display device to display a primary matrix, the primary matrix including a trigger column and a plurality of combinable columns, the trigger column and the plurality of combinable columns corresponding to a first plurality of virtual reels having respective pluralities of symbols defined thereon, the trigger column being predesignated as a column within the primary matrix for evaluation to determine if a trigger condition has been met, cause the first plurality of virtual reels to spin and stop, evaluate the trigger column to determine whether a stack of at least three symbols appears in the trigger column when the first plurality of virtual reels stops, wherein the stack of at least three symbols are defined on a single reel strip corresponding to the trigger column, a stack of at least three wild symbols appearing in the trigger column being the trigger condition, replace, in response to the appearance of the stack of at least three wild symbols in the trigger column, two or more reel strips corresponding to two or more columns of the plurality of combinable columns with an oversized reel strip corresponding to a combined column, the combined column defined by the two or more columns and excluding the trigger column, cause the display device to display a secondary matrix, the secondary matrix including the trigger column and the combined column, the trigger column and the combined column corresponding to a second plurality of virtual reels having respective pluralities of symbols defined thereon, wherein the respective symbols appearing in the combined column are oversized to span a space otherwise occupied by the plurality of combinable columns in the primary matrix, and while the stack of at least three symbols remain fixed in the trigger column, cause the remaining virtual reels of the second plurality of virtual reels to spin and stop, wherein at least a portion of at least one oversized symbol appears in the combined column.

2. The electronic gaming machine of claim 1, wherein the primary matrix comprises three rows and five columns, wherein a left-most and a right-most column among the five columns are defined as trigger columns of the primary matrix, and wherein a middle three columns of the five columns are defined as the plurality of combinable columns.

3. The electronic gaming machine of claim 2, wherein the secondary matrix comprises three rows and three columns, wherein a left-most and a right-most column among the three columns correspond to the trigger columns of the primary matrix, and wherein a center column of the three columns is defined as the combined column representing the combination of the plurality of combinable columns of the primary matrix.

4. The electronic gaming machine of claim 2, wherein the trigger condition comprises a wild symbol spanning the three rows of either of the trigger columns of the primary matrix.

5. The electronic gaming machine of claim 1, wherein, when executed, the instructions further cause the game controller to shift the stack of at least three symbols such that all of the stack appears in the trigger column of the primary matrix, the shift in response to at least one symbol of the stack appearing in the trigger column, but fewer than all of the symbols of the stack.

6. The electronic gaming machine of claim 1, wherein, when executed, the instructions further cause the game controller to shift the stack of at least three symbols such that the stack spans all of the trigger column of the primary matrix, the shift in response to at least one symbol of the stack appearing in the trigger column, but spanning less than all of rows of the primary matrix.

7. The electronic gaming machine of claim 1, wherein, when executed, the instructions further cause the game controller to determine a game award based at least upon an outcome of the second plurality of virtual reels including the portion of the at least one oversized symbol.

8. The electronic gaming machine of claim 1, further comprising a credit input device configured to receive a credit wager, wherein, when executed, the instructions further cause the game controller to:

receive, from the credit input device, a wager to initiate a primary game; and determine a primary game award upon stopping the first plurality of virtual reels and based on the wager and an evaluation of the respective pluralities of symbols displayed on the primary matrix.

9. A method comprising:

controlling a display device, by a game controller of an electronic gaming machine, to display a primary matrix comprising at least one trigger column and a plurality of combinable columns, the at least one trigger column and the plurality of combinable columns corresponding to a first plurality of virtual reels having respective pluralities of symbols defined thereon, the at least one trigger column being predesignated as a column within the primary matrix for evaluation to determine if a trigger condition has been met;

initiating a spin and stopping of the first plurality of virtual reels, evaluating the at least one trigger column to determine whether a stack of at least three wild symbols is displayed in the at least one trigger column upon the stopping of the first plurality of virtual reels, wherein the stack of at least three wild symbols are defined on a single reel strip corresponding to the trigger column, the stack of at least three wild symbols appearing in the at least one trigger column being the trigger condition;

replacing, in response to the stack of at least three wild symbols being displayed in the at least one trigger column, two or more reel strips corresponding to two or more columns of the plurality of combinable columns with an oversized reel strip corresponding to a combined column, the combined column defined by the two or more columns and excluding the at least one trigger column;

controlling the display device to display a secondary matrix including the at least one trigger column and the combined column representing the combination of the two or more columns of the plurality of combinable columns, the at least one trigger column and the combined column corresponding to a second plurality of virtual reels having respective pluralities of symbols defined thereon, wherein the respective symbols appearing in the combined column are oversized to span a space otherwise occupied by the plurality of combinable columns on the primary matrix; and while the stack of at least three wild symbols remain fixed in the at least one trigger column, initiating a spin and stopping of the remaining virtual reels of the second plurality of virtual reels, wherein at least a portion of one or more oversized symbols appear in the combined column.

10. The method of claim 9 further comprising controlling the display device to display an oversized wild symbol in the at least one trigger column to satisfy the trigger condition, the oversized wild symbol spanning all rows of the primary matrix.

11. The method of claim 10, wherein upon stopping of the first plurality of virtual reels, the oversized wild symbol is only partially displayed in the at least one trigger column, and wherein the method further comprises shifting the virtual reel corresponding to the at least one trigger column such that the oversized wild symbol is fully displayed in the at least one trigger column.

12. The method of claim 9, wherein upon stopping of the first plurality of virtual reels, the stack of at least three wild symbols is displayed in the at least one trigger column, but only partially spanning all rows of the primary matrix, and wherein the method further comprises shifting the virtual reel corresponding to the at least one trigger column such that the stack of at least three wild symbols spans all the rows of the primary matrix.

13. The method of claim 9, wherein controlling the display device to display the primary matrix further comprises displaying three rows and five columns, wherein a left-most column and a right-most column are defined as trigger columns, and wherein a center three columns are defined as the plurality of combinable columns.

14. The method of claim 13, wherein controlling the display device to display the secondary matrix further comprises displaying three rows and three columns, wherein a left-most column and a right most column correspond to the trigger columns of the primary matrix, and wherein a center column is defined as a combined column representing the plurality of combinable columns of the primary matrix and spanning a space otherwise occupied by the center three columns.

15. The method of claim 9 further comprising receiving a wager from a player at the electronic gaming machine to initiate a primary game, and determining a primary game award upon stopping the first plurality of virtual reels and based on the wager and an evaluation of the respective pluralities of symbols displayed on the primary matrix.

16. The method of claim 15 further comprising determining a secondary game award upon stopping the second plurality of virtual reels and based on an evaluation of the respective pluralities of symbols displayed on the secondary matrix, the secondary game award including at least one of a jackpot and a progressive.

* * * * *